US009080391B2

(12) United States Patent
Gawski et al.

(10) Patent No.: US 9,080,391 B2
(45) Date of Patent: Jul. 14, 2015

(54) INSULATED CONDUCTOR FOR DOWNHOLE DRILLING EQUIPMENT AND METHOD

(71) Applicant: HALLIBURTON ENERGY SERVICES, INC., Houston, TX (US)

(72) Inventors: Victor Gawski, Aberdeenshire (GB); John Kenneth Snyder, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/241,537

(22) PCT Filed: May 8, 2013

(86) PCT No.: PCT/US2013/040076
§ 371 (c)(1),
(2) Date: Feb. 27, 2014

(87) PCT Pub. No.: WO2014/182293
PCT Pub. Date: Nov. 13, 2014

(65) Prior Publication Data
US 2014/0332272 A1 Nov. 13, 2014

(51) Int. Cl.

| | |
|---|---|
| ***E21B 4/02*** | (2006.01) |
| ***F04C 2/107*** | (2006.01) |
| ***E21B 17/00*** | (2006.01) |
| ***E21B 17/02*** | (2006.01) |

(52) U.S. Cl.
CPC ..... *E21B 17/003* (2013.01); *E21B 4/02* (2013.01); *E21B 17/028* (2013.01); *F04C 2/1075* (2013.01)

(58) Field of Classification Search
CPC ..... E21B 4/02; E21B 17/003; E21B 17/028; F04C 2/1075
USPC ..... 166/65.1, 242.1; 175/57, 107; 418/48
See application file for complete search history.

(56) References Cited

U.S. PATENT DOCUMENTS

| | | | | |
|---|---|---|---|---|
| 2,531,958 | A | | 11/1950 | Williams, Jr. et al. |
| 3,857,776 | A | | 12/1974 | Titus et al. |
| 4,577,664 | A | | 3/1986 | Takahashi et al. |
| 4,669,555 | A | * | 6/1987 | Petree ..... 175/97 |
| 4,914,433 | A | | 4/1990 | Galle |
| 5,171,139 | A | * | 12/1992 | Underwood et al. ..... 418/48 |
| 5,832,604 | A | * | 11/1998 | Johnson et al. ..... 29/888.023 |
| 6,515,592 | B1 | | 2/2003 | Babour et al. |

(Continued)

OTHER PUBLICATIONS

International Search Report and Written Opinion of the International Searching Authority issued in International Application No. PCT/US2013/040076 on Jan. 22, 2014; 12 pages.

(Continued)

*Primary Examiner* — Robert E Fuller
(74) *Attorney, Agent, or Firm* — Anthony Iannitelli; Fish & Richardson P.C.

(57) ABSTRACT

A downhole drilling tool includes a tubular housing having a first longitudinal end and a second longitudinal end, and a stator disposed in the tubular housing, said stator defining an internal cavity passing there through. The stator includes at least a first protective electrically insulated layer, a second protective electrically insulated layer, and an electrically conductive layer disposed between the first and second protective layers. The electrically conductive layer coupled at a first end to a first electrical device and coupled at a second end to a second electrical device. A rotor is operatively positioned in the internal cavity to cooperate the stator.

34 Claims, 8 Drawing Sheets

(56) References Cited

U.S. PATENT DOCUMENTS

| | | | | |
|---|---|---|---|---|
| 6,763,887 | B2 | 7/2004 | Boyadjieff | |
| 6,799,632 | B2 | 10/2004 | Hall et al. | |
| 6,905,319 | B2 | 6/2005 | Guo | |
| 6,952,170 | B2 | 10/2005 | Aiello | |
| 7,168,510 | B2 | 1/2007 | Boyle et al. | |
| 7,683,802 | B2 | 3/2010 | Madhavan et al. | |
| 8,426,988 | B2 | 4/2013 | Hay | |
| 2006/0086536 | A1 | 4/2006 | Boyle et al. | |
| 2006/0151179 | A1* | 7/2006 | Boyadjieff et al. | 166/380 |
| 2009/0152009 | A1 | 6/2009 | Slay et al. | |
| 2012/0018227 | A1 | 1/2012 | Puzz et al. | |
| 2012/0024632 | A1 | 2/2012 | John | |
| 2013/0048384 | A1 | 2/2013 | Jarvis et al. | |

OTHER PUBLICATIONS

Lawrence et al., "Intelligent Wired Drill Pipe System Provides Significant Improvements in Drilling Performance on Offshore Australia Development," OTC 20067, Offshore Technology Conference, Houston, Texas, May 4-7, 2009, 8 pages.

Wang et al., "The New, Downlink Drilling Control System™ that Changes Conventional Drilling Operations," AADE-03-NTCE-47, AADE Technical Conference, Houston, Texas, Apr. 1-3, 2003, 12 pages.

Dalton et al., "The Benefits of Real-Time DownHole Pressure and Tension Data with Wired Composite Tubing," paper 2002-220, presented at the Petroleum Society's Canadian International Petroleum Conference, Calgary, Alberta, Canada, Jun. 11-13, 2002, 14 pages.

* cited by examiner 10
57
14
12
55
60
22
25
20
32
34
24
40
50

INSULATED CONDUCTOR FOR DOWNHOLE DRILLING EQUIPMENT AND METHOD

CLAIM OF PRIORITY

This application is a U.S. National Stage of PCT/US2013/040076 filed on May 8, 2013.

TECHNICAL FIELD

The present disclosure relates to systems, assemblies, and methods for conducting electrical power to and through downhole tools attached to a drill string.

BACKGROUND

Progressing cavity motors, also known as Moineau-type motors having a rotor that rotates within a stator using pressurized drilling fluid, have been used in wellbore drilling applications for many years. Some Moineau-type pumps and motors used in wellbore drilling include stators which have a polymer lining applied to the bore of the housing. Pressurized drilling fluid (e.g., drilling mud) is typically driven into the motor and into a cavity between the rotor and the stator lining, which generates rotation of the rotor and a resulting torque can be produced. The resulting torque is typically used to drive a working tool, such as a drill bit, to cut material.

DETAILED DESCRIPTION

Figure 1:
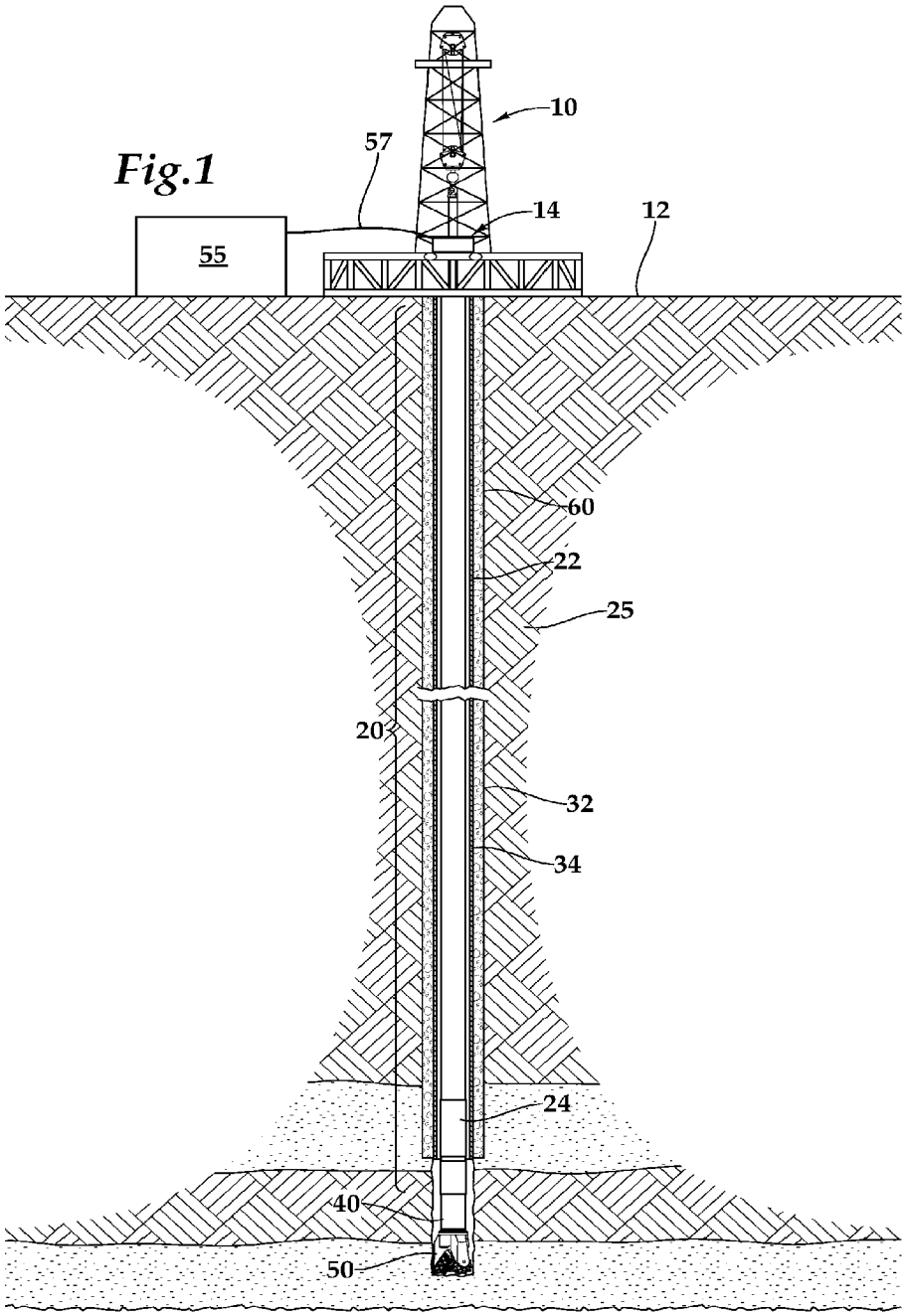
FIG. 1 is a schematic illustration of a drilling rig and downhole equipment disposed in a wellbore.

Referring to FIG. 1, in general, a drilling rig 10 located at or above the surface 12 rotates a drill string 20 disposed in the wellbore below the surface. The drill string typically includes drill pipe 22 and drill collars 24 that are rotated and transfer torque down the borehole to a drill bit 50 or other downhole equipment 40 (referred to generally as the "tool string") attached to a distal end of the drill string. The surface equipment 14 on the drilling rig rotates the drill string 20 and the drill bit 50 as it bores into the Earth's crust 25 to form a wellbore 60.

Figure 2A:
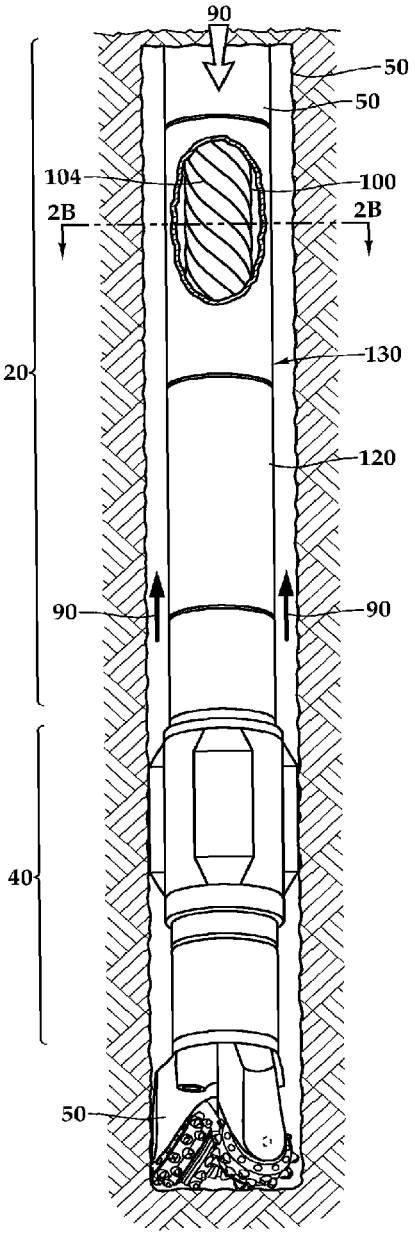
FIG. 2A illustrates a side view of an example downhole drilling assembly including a downhole drilling tool with portions of a tubular housing cut away for illustrating internal features of the downhole drilling motor.
Figure 2B:
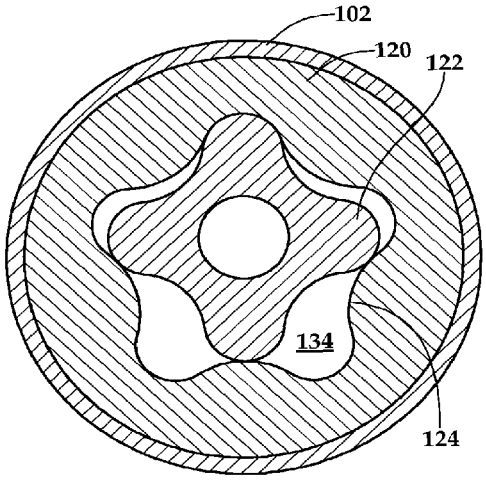
FIG. 2B is a cross-sectional view of a stator and rotor of a downhole drilling tool operatively positioned in a cavity defined by a stator disposed in the tubular housing.

In various implementations, the drill string includes a Moineau motor and the tool string 40 includes equipment that uses electrical power to operate (e.g., motors), equipment that is configured to receive electrical signals (e.g., actuators), and/or equipment that is configured to transmit electrical signals (e.g., sensors) to and/or from electrical equipment 55 located at the surface 12. The electrical equipment 55 is electrically connected to the drill string 20 by at least one electrical conductor 57. Rotation of the drill string 20 and components within the drill string 20, as well as the harsh environment of the wellbore 60, can lead to breakage of conventional electrical conductors. Such breakage results in additional work and expense needed to identify the location of the fault, to retrieve the corresponding section of the drill string, and to repair the damage, in addition to the costs associated with the resulting downtime Progressing cavity motors, such as those used in downhole drilling and pump assemblies, typically include a stator defining cavity and a rotor that is sized and configured to rotate within the cavity when pressurized fluid is applied to the cavity. FIG. 2A illustrates an example drilling assembly 50 disposed in the wellbore 60. In some implementations, the drilling assembly 50 can be the drill string 20. The distal end of the drilling assembly 50 includes the tool string 40 driven by a downhole motor 100 connected to the drill bit 50. The downhole motor 100 generally includes a tubular housing 102, which is typically formed of steel and encloses a power unit 104. The power unit 104 includes a stator 120 and a rotor 122. Referring to FIG. 2B, the stator 120 includes multiple (e.g., five) lobes, the rotor always has one less lobe than the stator 124 defining a cavity 134. The stator 120 can have two or more lobes. See exemplary configurations in FIGS. 4A to 4F.

The rotor 122 is operatively positioned in the cavity 134 to cooperate with the stator lobes 124. Applying fluid pressure to the cavity 134 typically causes the rotor 122 to rotate within the stator 120 in cooperation with the lobes 124. For example, referring to FIGS. 2A and 2B, pressurized drilling fluid 90 (e.g., drilling mud) can be introduced at an upper end of the power unit 104 and forced down through the cavity 134. As a result of the pressurized drilling fluid 90 flowing through the cavity 134, the rotor 122 rotates which causes the drill bit 136 to rotate and cut away material from the formation. From the cavity 134, the drilling fluid 90 is expelled at the lower end and then subsequently exhausted from the motor then the drill bit 50.

During a drilling operation, the drilling fluid 90 is pumped down the interior of the drill string 20 (shown broken away) attached to downhole drilling motor 100. The drilling fluid 90 enters cavity 134 having a pressure that is imposed on the drilling fluid by pumps (e.g., pumps at the surface). The pressurized drilling fluid entering cavity 134, in cooperation with the geometry of the stator 120 and the rotor 122, causes the rotor 122 to turn to allow the drilling fluid 90 to pass through the motor 100. The drilling fluid 90 subsequently exits through ports (e.g., jets) in the drill bit 50 and travels upward through an annulus 130 between the drill string 20 and the wellbore 60 and is received at the surface where it is captured and pumped down the drill string 20 again.

These downhole drilling motors fall into a general category referred to as Moineau-type motors. Some conventional Moineau-type pumps and motors include stators that have stator contact surface formed of a rubber or polymer material bonded to the steel housing. However, in the dynamic loading conditions typically involved in downhole drilling applications, substantial heat can be generated in the stator and the rotor. Since rubber is generally not a good heat conductor, thermal energy is typically accumulated in the components that are made of rubber (e.g., the stator). This thermal energy accumulation can lead to thermal degradation and, therefore, can lead to damage of the rubber components and to separation of the rubber components Additionally, in some cases, the drilling fluid to be pumped through the motor is a material that includes hydrocarbons. For example, oil-based or diesel-based drilling fluids can be used which are known to typically deteriorate rubber. Such deterioration can be exacerbated by the accumulation of thermal energy. Water and water based fluids can present a problem for rubber components in drilling applications.

For optimum performance of the drilling motor, there is typically a certain required mating fit (e.g., clearance or interference) between the rubber parts of the stator and the rotor. When the rubber swells, not only the efficiency of the motor is affected but also the rubber is susceptible to damage because of reduced clearance or increased interference between the rotor and the stator.

Contact between the stator and the rotor during use causes these components to wear (i.e., the rubber portion of the stator or the rotor), which results in the mating fit between the stator and the rotor to change. In some cases, the rotor or the stator can absorb components of the drilling fluid and swell, which can result in the clearance getting smaller, causing portions of the rotor or stator to wear and break off. This is generally known as chunking. In some cases, the chunking of the material can result in significant pressure loss so that the power unit is no longer able to produce suitable power levels to continue the drilling operation. Additionally or alternatively, in some cases, chemical components in the drilling fluid used can degrade the rotor or the stator and cause the mating fit between them to change. Since the efficient operation of the power unit typically depends on the desired mating fit (e.g., a small amount of clearance or interference), the stator and/or the rotor can be adjusted during equipment maintenance operations at surface to maintain the desired spacing as these components wear during use.

In some implementations, the tool string 40 includes electrical elements such as motors, actuators and sensors that are in electrical communication with electrical equipment 55 located at the surface 12. The previously discussed downhole conditions can be highly adverse to conventional electrical conductors, such as insulated wires, as such conductors may interfere with the mechanical operation of the drill string 20 or may be susceptible to breakage, erosion, corrosion, or other damage when exposed to the conditions experienced during drilling operations. In order to provide power to such electrical elements, the drill string 20 and/or elements of the tool string 40 include electrically conductive elements that will be discussed in the descriptions of FIGS. 3-11.

Figure 3A:
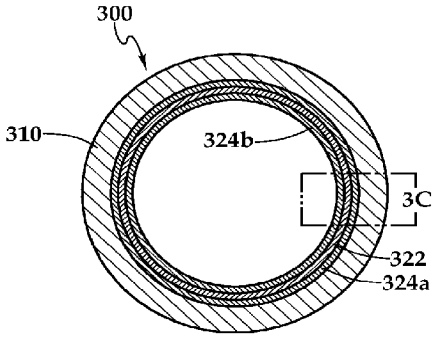
FIGS. 3A-3C are cross-sectional views of an example stator that includes an insulated conductor.
Figure 3C:
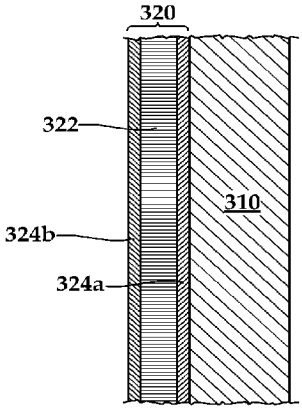
Figure 3B:
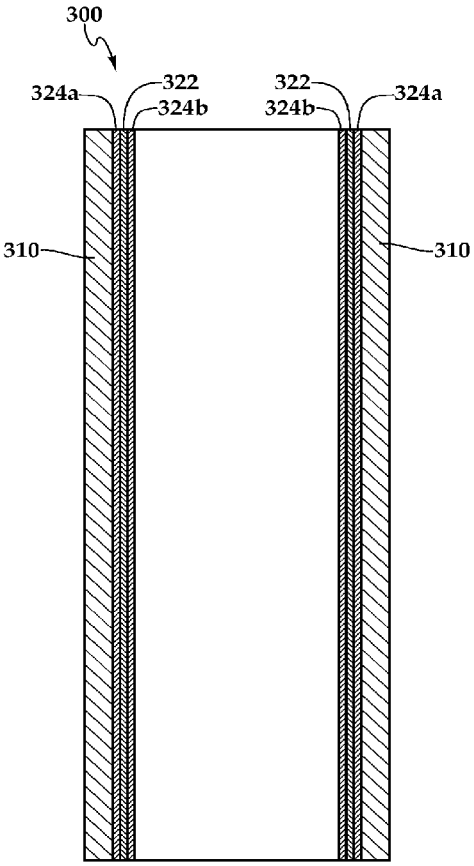

FIGS. 3A-3C are cross-sectional views of an example stator 300 of a downhole drilling tool (e.g., a downhole motor 300) that includes an insulated conductive layer 320. In some implementations, the stator 300 can be part of the drill string 20 of FIG. 1 or the stator 120 of FIGS. 2A-2B.

In some implementations the insulated conductors disclosed herein may be used to pass one or more electrical conductors through housings and around drive shafts of other downhole drilling tools such as RSS steerable tools, turbines, anti-stall tools and downhole electric power generators. In other implementations, the insulated conductors may be passed through downhole reciprocating tools such as jars and anti-stall tools.

In general, when used with components such as the bores of downhole motor stator housings, the insulated conductive layer 320 can take the form of a circumferential layer, a semi circumferential layer, a thin straight strip, a spiral strip, or any other appropriate conductive layer which is insulated, geometrically unobtrusive (e.g., thin in wall section, with good adhesion), and does not negatively affect stator elastomer bonding or geometry integrity.

The stator 300 includes a tubular housing 310 which is typically formed of steel. The insulated conductive layer 320 is included substantially adjacent to an inner surface of the tubular housing 310. The insulated conductive layer 320 may be formed as a circumferential layer, a semi circumferential layer, a thin straight strip, a spiral strip, or any other appropriate conductive layer. In some implementations, the insulated conductive layer 320 may conform to the geometry of the inner surface of the tubular housing 310.

Referring now to FIG. 3C, a section of the stator 300 is shown in greater detail. The insulated conductive layer 320 includes a conductive sub-layer 322, an insulating sub-layer 324*a*, and an insulating sub-layer 324*b*. The conductive sub-layer 322 is formed of an electrically conductive material that is molded, extruded, sprayed, or otherwise formed to substantially comply with the geometry of the inner surface of the tubular housing 310. The insulating sub-layers 324*a*, 324*b* provide electrical insulation between the conductive sub-layer 322 and other adjacent layers (e.g., the tubular housing 310) and/or from other conductive layers as will be discussed in the descriptions of FIGS. 4A-4B and 5. In some implementations, the insulating sub-layers 324*a*, 324*b* may be molded, sprayed, or otherwise formed using polymers or non-electrically conductive metallic materials to an electrically insulating sleeve substantially adjacent to the conductive sub-layer 322. In general, the conductive sub-layer 322 is sandwiched between the insulating sub-layer 324*a* and the insulating sub-layer 324*b*. The insulating sub-layers 324*a*, 324*b* may be applied to the full circular bore or the full outer surface of the tubular housing 310, or may be applied to discrete areas, with the conductive sub-layer 322 placed between the insulated areas. In some embodiments, the conductive sub-layer 322 can be formed or assembled as a series of insulated conductive rings or cylindrical sub-sections along the inner surface of the tubular housing 310.

In some embodiments, the insulating sub-layer 324*b* can be a protective layer provided radially between the conductive sub-layer 322 and the bore of the tubular stator 300. The insulating sub-layer 324*b* can protect the conductive sub-layer 322 from the erosive and abrasive conditions that may be present within the bore, e.g., wear from contact with a rotor or shaft, wear and erosion from mud or other fluid flows, chemical degradation due to substances carried by drilling mud or fluid flows. In some embodiments, the insulating sub-layer 324*b* can be molded, sprayed, or otherwise take the form of a protective sleeve. In some embodiments, the insulating sub-layer 324*b* may implement nano-particle technology, and/or may be thin, e.g., a fraction of a millimeter, to several millimeters thick. In some embodiments, the insulating sub-layer 324*b* may provide anti-erosion, anti-abrasion properties, and/or electrical insulating properties.

In some implementations, the width, thickness, and material used as the conductive sub-layer 322 may be selected based on the amount of data or power that is expected to be transmitted through it. In some implementations, the conductive material, geometry, and/or location conductive sub-layer 322 may be selected to allow for the bending, compressing, and/or stretching of the drilling tubulars as is experienced in a downhole drilling environment.

Figure 3D:
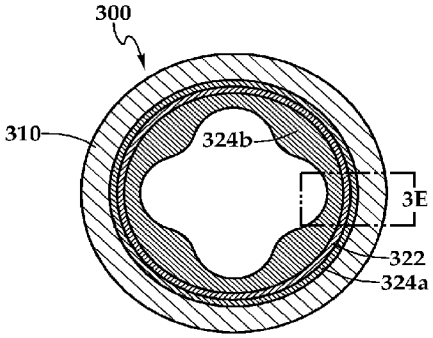
FIGS. 3D and 3E are cross sectional views of another implementation of an example stator disposed in a tubular housing.
Figure 3E:
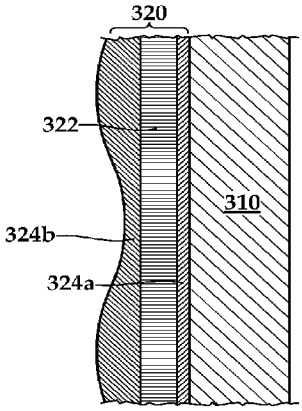

FIGS. 3D and 3E illustrate alternative stator geometry for the insulating sub layer 324*b*.

Figure 4A:
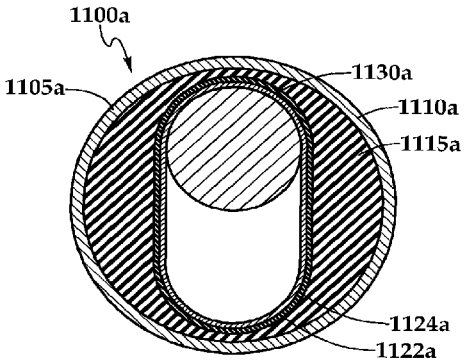
FIGS. 4A-4F illustrate example configurations of some implementations of stator and rotor lobes
Figure 4B:
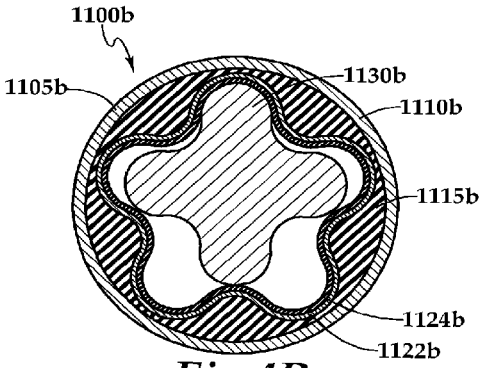
Figure 4C:
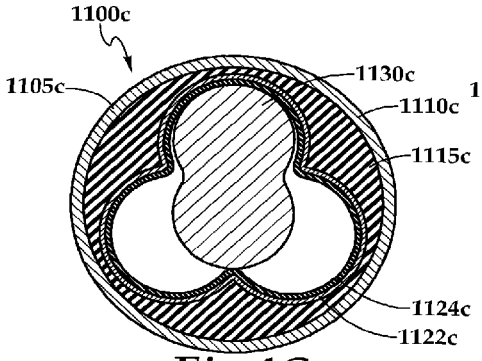
Figure 4D:
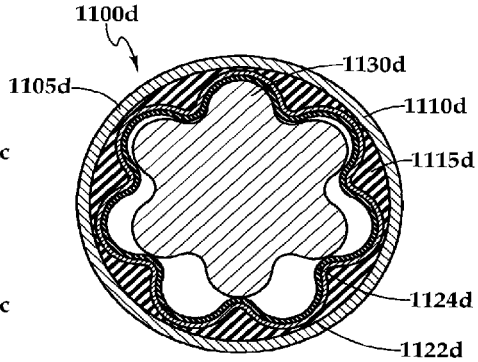
Figure 4E:
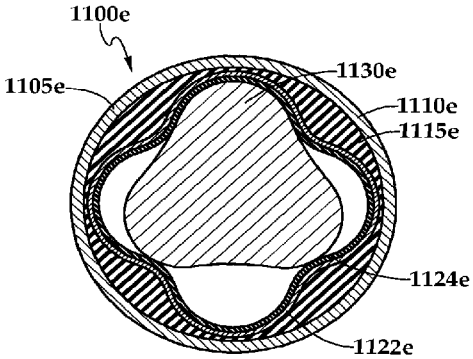
Figure 4F:
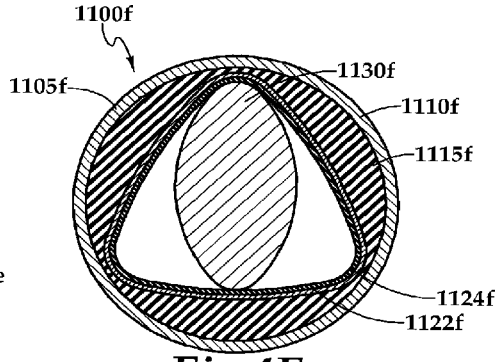

FIGS. 4A to 4F illustrate example configurations of additional example embodiments of stator and rotor lobes. FIG. 4A is a cross-sectional end view 1100*a* of an example stator 1105*a* that includes an example tubular housing 1110*a*, an example elastomer layer 1115*a*, an example conductive sub-layer 1122*a*, an example insulating layer 1124*a*, and an example rotor 1130*a*. FIG. 4B shows a cross-sectional end view 1100*b* of an example stator 1105*b* that includes an example tubular housing 1110*b*, an example elastomer layer 1115*b*, an example conductive sub-layer 1122*b*, an example insulating layer 1124*b*, and an example rotor 1130*b*. FIG. 4C shows a cross-sectional end view 1100*c* of an example stator 1105*c* that includes an example tubular housing 1110*c*, an example elastomer layer 1115*c*, an example conductive sub-layer 1122*c*, an example insulating layer 1124*c*, and an example rotor 1130*c*. FIG. 4D shows a cross-sectional end view 1100*d* of an example stator 1105*d* that includes an example tubular housing 1110*d*, an example elastomer layer 1115*d*, an example conductive sub-layer 1122*d*, an example insulating layer 1124*d*, and an example rotor 1130*d*. FIG. 4E shows a cross-sectional end view 1100*e* of an example stator 1105*e* that includes an example tubular housing 1110*e*, an example elastomer layer 1115*e*, an example conductive sub-layer 1122*e*, an example insulating layer 1124*e*, and an example rotor 1130*e*. FIG. 4F shows a cross-sectional end view 1100*f* of an example stator 1105*f* that includes an example tubular housing 1110*f*, an example elastomer layer 1115*f*, an example conductive sub-layer 1122*f*, an example insulating layer 1124*f*, and an example rotor 1130*f*.

Figure 5:
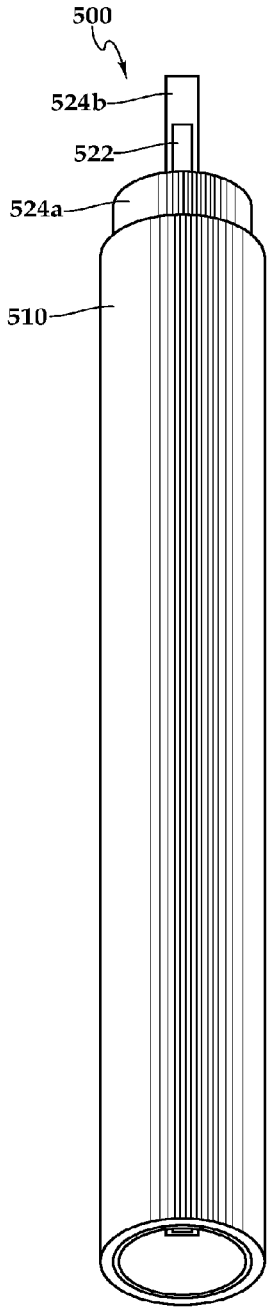
FIG. 5 is a cross-sectional view of another example stator that includes a substantially straight insulated conductive strip.

FIG. 5 is a view of another example stator 500 that includes a substantially straight insulated conductive strip. In the illustrated example, the stator 500 includes a tubular housing 510 and a conductive strip layer 522. Although one conductive strip layer is described in this example, in some embodiments, two, three, four, or any other appropriate number of conductive strip layers may be used.

The conductive strip layer 522 is arranged substantially parallel to the longitudinal geometry of the inner surface of the insulating sub-layer 524*a*. The conductive strip layer 522 is electrically insulated from the tubular housing 510 by the insulating sub-layer 524*a*, and is electrically insulated from the bore of the stator 500 by an insulating sub-layer 524*b*. The conductive strip layer may take a helical form in the bore of the housing or may be of other regular or irregular geometry.

Figure 6A:
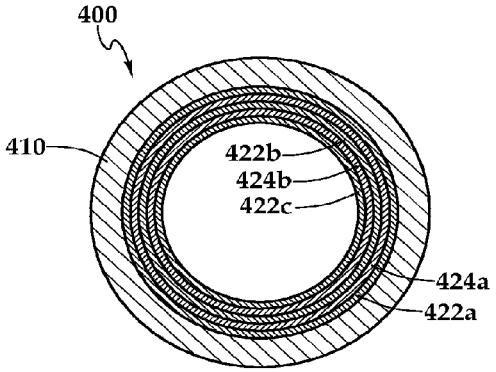
FIGS. 6A-6B are cross-sectional views of an example stator that includes multiple insulated conductors.
Figure 6B:
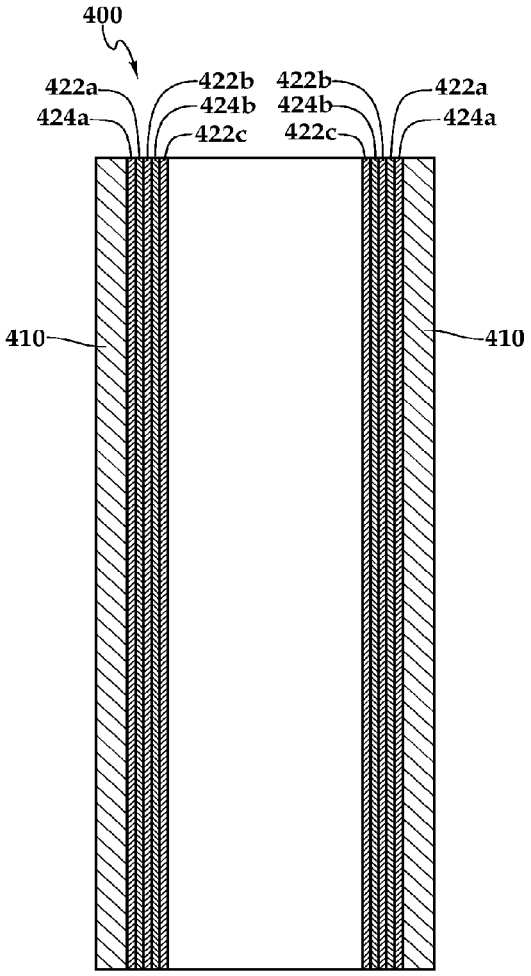

FIGS. 6A-6B are cross-sectional views of an example stator 400 that includes multiple insulated conductors. In the illustrated example, the stator 400 includes a tubular housing 410 and two conductive layers 422*a* and 422*b*. Although two conductive layers are described in this example, in some embodiments, three, four, or any other appropriate number of conductive layers may be used.

The conductive layers 422*a*-422*b* are concentric layers formed to substantially conform to the geometry of the inner surface of the tubular housing 410. The conductive layer 420*a* is separated from the tubular housing 410 by an insulating sub-layer 424*a*. The conductive layers 422*a*-422*b* are separated by the insulating sub-layers 424*b* of FIG. 3C, and the conductive layer 422*b* is electrically insulated from the bore of the stator 400 by an insulating sub-layer 424*c*.

Figure 7:
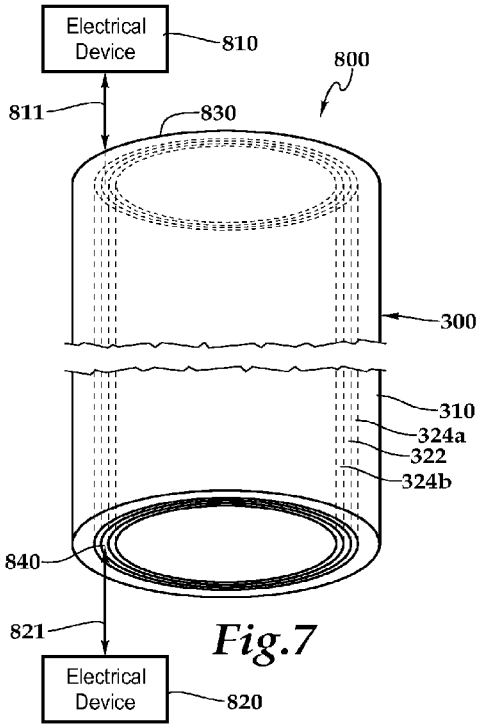
FIG. 7 illustrates a conceptual example implementation of a stator that includes an insulated conductor.

FIG. 7 illustrates a conceptual example implementation 800 of the example stator 300. In the illustrated example, a first electrical device (electrical power or data generator) 810 is electrically connected to a second electrical device (electrical power consumer or data receiver) 820 by the conductive sub-layer 322 of the stator 300. The first and second electrical devices 810, 820 may be, for example, an electricity generating dynamo and electro-mechanical actuator (e.g. a downhole drilling component such as an adjustable gauge stabilizer, traction device or a packer), or a digital data transmitter and digital data acquisition component. Each electrical device 810, 820 may include electronic components such as logic circuits, integrated circuits, and memory, optionally governed by firmware or other computer usable code for electronically controlling operation of the electrical devices 810, 820. The first electrical device 810 is connected to the conductive sub-layer 322 at a first end 830 of the stator 300, and the second electrical device 820 is connected to the conductive sub-layer 322 at a second end 840 of the stator 300. The conductive sub-layer 322 provides an electrical pathway between the first end 830 and the second end 840 of the stator 300, to facilitate electrical communication between the first electrical device 810 and the second electrical device 820. The insulating sub-layers 324*a*, 324*b* provide electrical insulation for the conductive sub-layer 322. In some implementations, the first electrical device 810 and/or the second electrical device 820 can be a source of electrical energy, a consumer of electrical energy, a passive or active component receiving an electrical signal (e.g. data signal), an electrical ground, or combinations of these and/or other appropriate electrical components. The electric current being conducted from electrical device 810 through a first electrical end conductor 811 to the conductive sub layer 322 may include an electrical signal being transmitted and/or electrical power being conducted. For example, the first electrical device 810 can provide an electrical signal via a first end conductor 811 to the first end 830, and the signal can be transmitted along the conductive sub-layer 322 to the second end 840 or alternatively instead of a signal, electrical power may be conducted through the conductive sub layer and used to power a device in the tool string. Electric current is received from the electrically conductive layer at a second end 840 and may be transmitted via a second end conductor 821. For example, the second electrical device 820 is connected via second end conductor 821 to the conductive sub-layer 322 to receive the signal that has been transmitted from the first electrical device 810 or alternatively receive the electrical power conducted through the conductive layer. It will be appreciated that a signal or power may be transmitted in either direction through the conductive layer. It will be appreciated that the electrical end conductor 811 and 821 may be any conductive device (e.g. a simple wire or a male/female type electrical coupler.

The implementation 800 can provide efficient and reliable electronic power and/or data transmission through downhole tools and/or drill strings. Power and/or data can be conducted through insulated conducting sleeves, e.g., the conductive sub-layer 322 and the insulating sub-layers 324*a*, 324*b*, which can form a solid part of drilling equipment cylindrical tubular components such as the stator 300. In some implementations, the stator 300 may provide electrical connectivity without significantly impacting the physical operational integrity of the drilling equipment components, e.g., the cross-sectional geometry of the stator 300 may not be significantly impacted by the inclusion of the conductive sub-layer 322 and the insulating sub-layers 324*a*, 324*b*. In some implementations, adverse drilling fluid erosion, corrosion, vibration, and/or shock loading effects on the conductor may be reduced. For example, the flow of fluid through the bore of the stator 300 may be substantially unaffected by the presence of the conductive sub-layer 322 and the insulating sub-layers 324*a*, 324*b*, since the bore of the stator 300 can be formed with an inner surface geometry that is similar to stators not having insulated conducting sleeves, such as the example drill string 20 of FIGS. 2A-2B.

Figure 8:
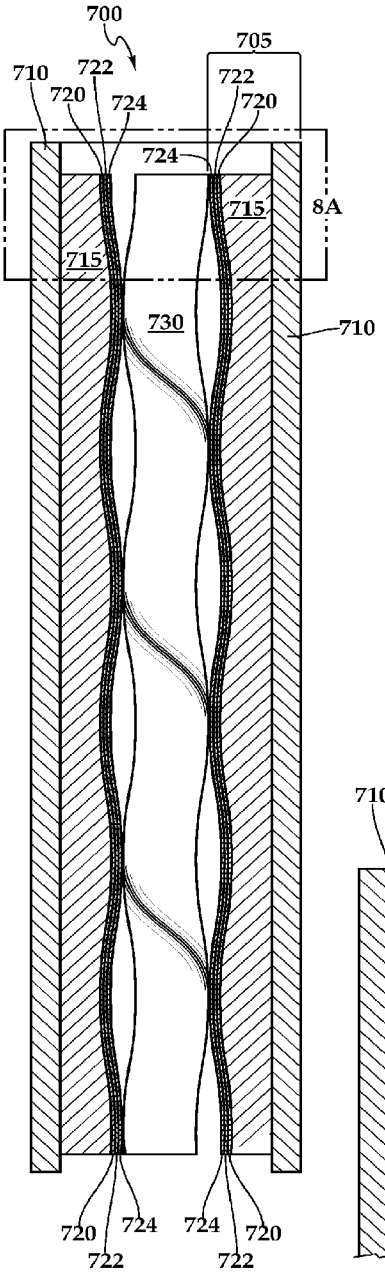
FIGS. 8 and 8A are cross-sectional side views of a stator and rotor of a downhole drilling motor.
Figure 8A:
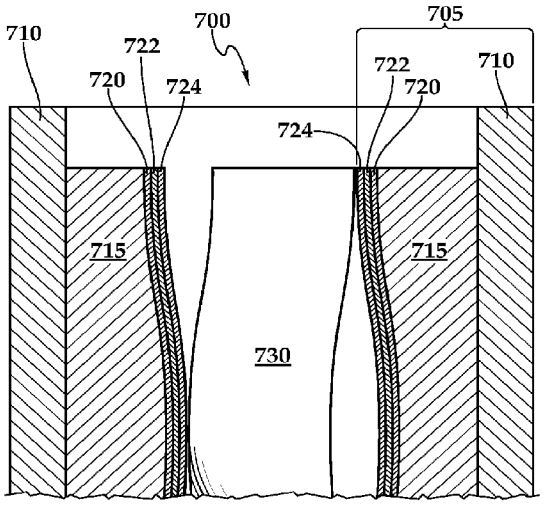

FIGS. 8 and 8A are cross-sectional side views of an example stator 705 and example rotor 730 of an example downhole drilling motor 700. The stator 705 includes a tubular housing 710 (e.g. metal housing). In some embodiments, an additional helically lobed metal insert 715 is inserted into housing 710 or a helical lobe form is produced directly on the bore of housing 710. Then an insulated layer 720 is first applied to the inner surface of insert 720 or alternatively to the bore of the housing 710, then the conductor layer 722 is applied and then the elastomer sub layer 724 is applied. FIG. 8A is an enlarged portion of FIG. 8 and illustrates these applied layers.

The conductive sub-layer 722 is formed along the complex inner surface of the insulated layer 720 which is applied to the metal insert layer 715 (or alternatively the bore of the housing 210). In some embodiments, the conductive sub-layer 722 may be an electrically conductive sleeve or strip that is inserted or otherwise applied to the inner surface of the elastomer layer 715. In some embodiments, the conductive sub-layer 722 may be a fluid or particulate compound that is sprayed, coated, or otherwise deposited upon the inner surface of the metal insert layer 715.

The insulating sub-layer 724 is formed along the concentrically inward surface of the conductive sub-layer 722. The insulating sub layer 724 may be polymeric and therefore deformable when the rotor is rotated inside the stator assembly. The insulating sub-layer 724 can protect the conductive sub-layer 722 from the erosive and abrasive conditions that may be present within the bore, e.g., wear from contact with the rotor 730, wear from mud or other fluid flows, chemical degradation due to substances carried by mud or fluid flows. In some embodiments, the insulating sub-layer 724 can be molded, sprayed, or otherwise take the form of a protective sleeve. In some embodiments, the insulating sub-layer 724 may implement nano-particle technology, and/or may be thin, e.g., a fraction of a millimeter to several millimeters thick. In some embodiments, the insulating sub-layer 724 may provide anti-erosion, anti-abrasion properties, and/or electrical insulating properties.

In some embodiments, the elastomer layer 720 applied to metal layer 715 can provide electrical insulation. For example, the elastomer layer 720 applied on metal layer 715 may also perform the function of an insulating sub-layer between the conductive sub-layer 722 and the tubular housing 710.

Figure 9A:
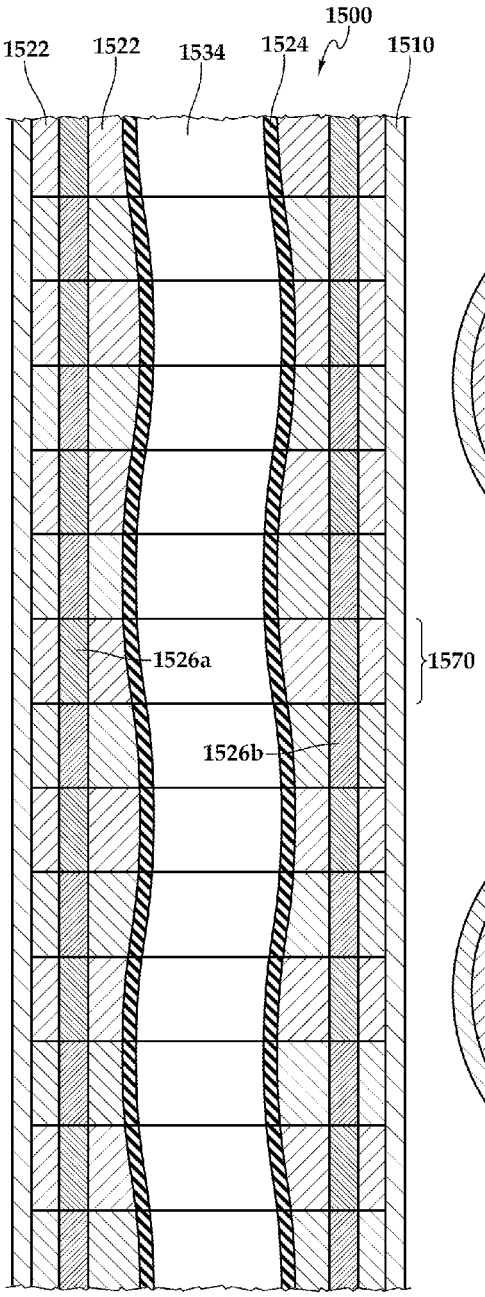
FIG. 9A is a cross-sectional view of an example sectional stator of a downhole drilling motor.
Figure 9B:
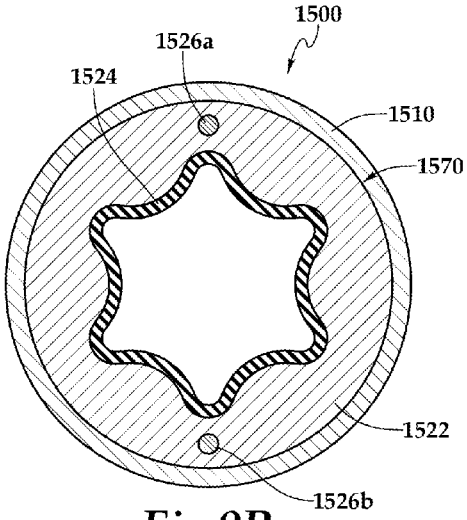
FIG. 9B is an end view of an example stator section.

FIG. 9A is a cross-sectional view of an example sectional stator 1500. The stator 1500 includes a tubular housing 1510 and a collection of stator sections 1570. As shown in FIG. 9B, each stator section 1570 of the stator 1500 includes a metal insert layer 1522. In some embodiments, the insert layer 1522 can be an elastomer layer.

A conductive sub-section 1526*a* and a conductive sub-section 1526*b* are formed within a portion of the insert layer 1522. In some embodiments, the conductive sub-sections 1526*a*, 1526*b* may be electrically conductive sleeves or plugs that are inserted or otherwise applied to sub-sections of the insert layer 1522.

In some embodiments, the insert layer 1522 can provide electrical insulation. For example, the insert layer 1522 may also perform the function of an insulating sub-layer between the conductive sub-sections 1526*a*, 1526*b* and the tubular housing 1510.

Referring again to FIG. 9A, the stator 1500 includes a collection of the stator sections 1570, arranged as a lateral stack or row transverse to the longitudinal axis of the stator 1500 along the interior of the tubular housing 1510. The stator sections 1570 are oriented such that the conductive sub-sections 1526*a*, 1526*b* substantially align and make electrical contact with each other to provide insulated electrically conductive paths along the length of the stator 1500.

In some embodiments, the conductive sub-sections 1526*a*, 1526*b* may be replaced by open, e.g., unfilled, sub-sections. For example, the stator sections 1570 can be oriented such that the open sub-sections substantially align and form a bore along the length of the stator 1500. In some embodiments, one or more conductive wires or laminated conductive sleeves may be passed through the bore formed by the open sub-sections.

Figure 10:
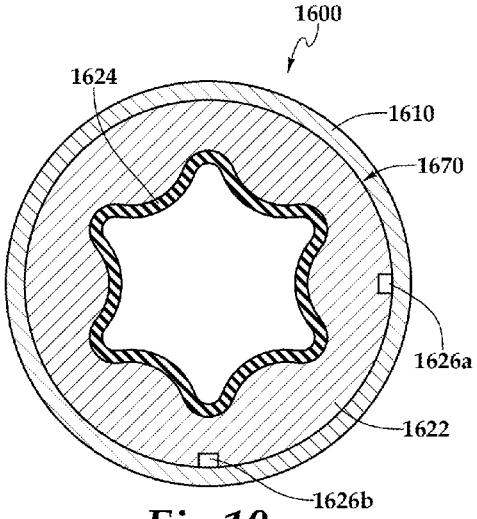
FIG. 10 is an end view of another example stator section.

FIG. 10 is an end view of another example stator section 1670 of an example stator 1600. In some implementations, the stator section 1670 may be used in place of the stator sections 1570 of FIG. 12A. The stator section 1670 includes a metal insert layer 1622. In some embodiments, the insert layer 1622 can be the elastomer layer. In some applications the disc or plate type stacked metal inserts 1622 are steel. They have an internal lobed geometry to which a thin layer of elastomer 1624 is applied. In other implementations, an insulated layer will first be applied to the internal lobed profile of the stacked metal inserts 1622, then there is a conductor layer or strip, then there is a final elastomer layer (the final layer being similar to the currently applied thin elastomer layer on stators).

A conductive sub-section 1626*a* and a conductive sub-section 1626*b* are formed within a portion of the elastomer layer 1622. In some embodiments, the conductive sub-sections 1626*a*, 1626*b* may be electrically conductive sleeves or plugs that are inserted or otherwise applied to sub-sections of the elastomer layer 1622.

In some embodiments, the conductive sub-sections 1626*a*, 1626*b* can include one or more electrically insulating and/or conductive sub-layers. For example the conductive sub-sections 1626*a*, 1626*b* may each include an electrically conductive sub-layer surrounded by an electrically insulating sub-layer, e.g., to prevent the electrically conductive sub-layer from shorting out to the tubular housing 1610. In some embodiments, the conductive sub-sections 1626*a*, 1626*b* may be replaced by open, e.g., unfilled, sub-sections. For example, one or more electrical conductors may be passed through the open subsections to provide an electrical signal path along the length of the stator 1600

Figure 11:
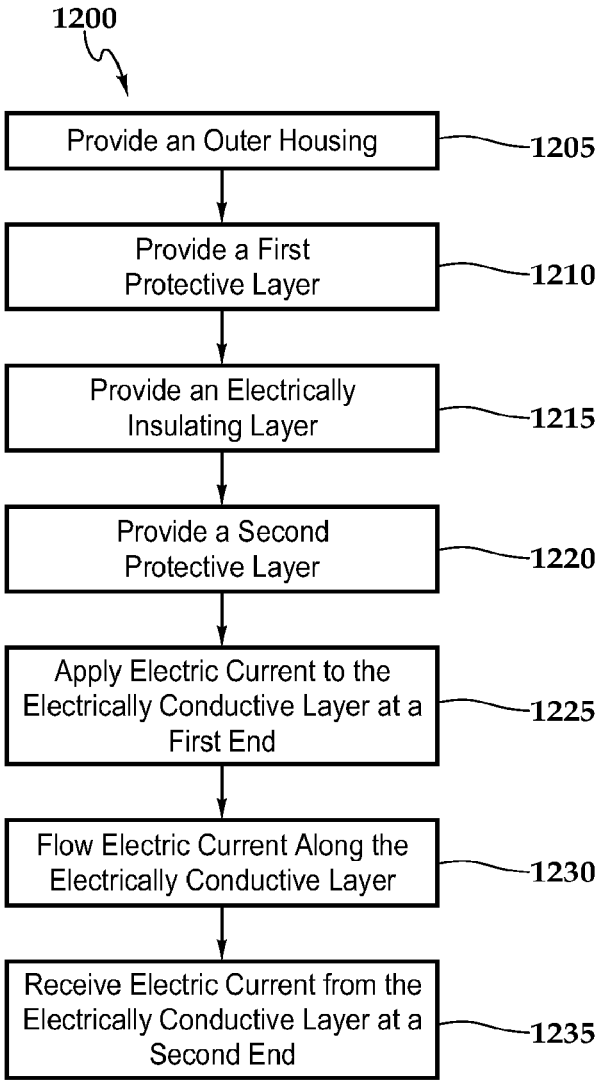
FIG. 11 is a flow diagram of an example process for using a stator that includes an insulated conductor

In some implementations, the stators 300, 400, 500, 600, 705, 905, 1005 and/or 1105*a*-1105*f* may be used in conjunction with existing threaded connection conductor couplings, e.g., ring type couplings which fit between a pin connection nose and a box connection bore back upon tubular component assembly, to permit electronic signal and data to travel between components located along a drill string FIG. 11 is a flow diagram of an example process 1200 for using a stator that includes an insulated conductor. In some implementations, the process 1200 may describe and/or be performed by any of the example stators 300, 400, 500, 600, 705, 905, 1005 and/or 1105*a*-1105*f*.

At 1205, an outer housing is provided. For example, in the example of FIG. 3A to 3F, the tubular housing 310 is provided.

At 1210, a first protective layer is provided. For example, the insulating sub-layer 324*a* is formed as an inwardly concentric layer upon the tubular housing 310.

At 1215, an electrically conductive layer is provided. For example, the conductive sub-layer 322 is formed along the interior surface of the insulating sub-layer 324*a*.

At 1220, a second protective layer is provided. For example, the insulating sub-layer 324*b* is formed as an inwardly concentric layer upon the conductive sub-layer 322.

At 1225, electric current is applied to the electrically conductive layer at a first end. For example, electrical power from the first electrical device 810 is applied to the conductive sub-layer 322 at the first end 830.

At 1230, electric current is flowed along the electrically conductive layer. The electric current may include an electrical signal being transmitted and/or an electrical power being conducted. For example, the first electrical device 810 can provide an electrical signal to the first end 830, and the signal can be transmitted along the conductive sub-layer 322 to the second end 840 or alternatively instead of a signal, electrical power may be conducted through the conductive sub layer and used to power a device in the tool string (see FIG. 7 and text describing FIG. 7).

At 1235, electric current is received from the electrically conductive layer at a second end. For example, the second electrical device 820 is connected to the conductive sub-layer 322 to receive the signal that has been transmitted from the first electrical device 810 or alternatively receive the electrical power conducted through the conductive layer. It will be appreciated that a signal may be transmitted in either directions through the conductive layer and electrical power may be transmitted in either direction through the conductive layer (see FIG. 7 and text describing FIG. 7)

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A downhole drilling motor for well drilling operations, the downhole drilling tool comprising:

a tubular housing having a first longitudinal end and a second longitudinal end and a longitudinal bore having a sidewall;

a stator disposed in the longitudinal bore of the tubular housing, said stator defining an internal cavity passing therethrough, wherein the stator comprises:

a first protective electrically insulated layer, a second protective electrically insulated layer, and at least one electrically conductive layer disposed between the first and second electrically protective layers, an outer surface of the first protective electrically insulated layer being disposed as a first substantially circumferential layer upon at least a portion of an inner surface of the sidewall of the longitudinal bore of the tubular housing, the electrically conductive layer being disposed as a second substantially circumferential layer upon at least a portion of an inner surface of the first protective layer, and the second protective electrically insulated layer being disposed as a third substantially circumferential layer upon at least a portion of an inner surface of the electrically conductive layer, said electrically conductive layer electrically coupled at a first end to a first electrical end conductor disposed proximal to the first longitudinal end of the tubular housing and electrically coupled at a second end to a second electrical end conductor disposed proximal to the second longitudinal end of the tubular housing; and a rotor operatively positioned in the internal cavity to cooperate with the stator.

2. The motor of claim 1 wherein the first electrical end conductor is electrically coupled to a first electrical device comprising an electric power generator and the second electrical end conductor is electrically coupled to a second electrical device that comprises an electrical power consumer.

3. The motor of claim 1 wherein the first electrical end conductor is electrically coupled to a first electrical device comprising a data generating device and the second electrical end conductor is electrically coupled to a second electrical device that comprises a data receiver.

4. The motor of claim 1, wherein the first electrical end conductor is in electronic communication with the second electrical end conductor via the at least one conductive layer disposed in the stator.

5. The motor of claim 1 wherein a signal from a first device received at the first electrical end conductor is transmitted to the second electrical end conductor via the at least one conductive layer disposed in the stator.

6. The motor of claim 1 wherein a signal from a second device is received at the second electrical end conductor and is transmitted to the first electrical end conductor via the at least one conductive layer disposed in the stator.

7. The motor of claim 1 wherein an electrical current received at the first electrical end conductor is conducted to the second electrical end conductor via the at least one conductive layer disposed in the stator.

8. The motor of claim 1 wherein an electric current received at the second electrical end conductor is conducted to the first electrical end conductor via the at least one conductive layer disposed in the stator.

9. The motor of claim 1, wherein the first protective electrically insulated layer is disposed along an inner surface of the tubular housing, the electrically conductive layer is disposed along an inner surface of the first protective electrically insulated layer, and the second protective electrically insulated layer is disposed along an inner surface of the electrically conductive layer.

10. The motor of claim 1, wherein at least one of the first protective electrically insulated layer and the second protective electrically insulated layer is electrically non-conductive.

11. The motor of claim 1, wherein the electrically conductive layer comprises a first electrically conductive layer and said tool further comprises a second electrically conductive layer that is electrically insulated from the first electrically conductive layer.

12. The motor of claim 11, wherein the second electrically conductive layer is disposed along an inner surface of the second protective electrically insulated layer, and a third protective electrically insulated layer is disposed along an inner surface of the second electrically conductive layer.

13. The motor of claim 11, wherein the second electrically conductive layer is disposed parallel to the first electrically conductive layer.

14. The motor of claim 1, wherein the inner surface of the first protective electrically insulated layer comprises a curved inner surface, and the electrically conductive layer is disposed adjacent to the curved inner surface of the first protective layer.

15. The motor of claim 1, wherein the second substantially circumferential layer is a completely circumferential layer disposed about a longitudinal axis of the housing.

16. The motor of claim 1, wherein the electrically conductive layer is disposed a helical arrangement adjacent to the first and second protective electrically insulated layers disposed in a helical arrangement in the stator disposed in the housing.

17. The motor of any claim 1, wherein the stator comprises a plurality of lateral layers of stator sections including at least one conductive subsection in each layer, said conductive sub section aligned with a conductive subsection in an adjacent stator section and each said conductive sub section is coupled electrically to an adjacent conductive sub section.

18. The motor of claim 17 wherein the conductive sub section comprises a conductive sleeve disposed in the conductive sub section.

19. The motor of claim 18 wherein the conductive sub section comprises a conductive plug disposed in the conductive sub section.

20. The motor of claim 1, wherein the stator further comprises a plurality of lateral layers of stator sections including at least one opening in each layer, said opening aligned with an opening in an adjacent stator section to form a continuous passage through the stator.

21. The motor of claim 20 wherein an electrical conductor is disposed in the continuous passage in the stator.

22. The motor of any claim 1, wherein the stator further comprises an insert layer disposed longitudinally and adjacent to an interior surface of the tubular housing.

23. The motor of claim 22 wherein the insert layer is metallic.

24. The motor of claim 22 wherein the insert layer is formed from a polymeric material.

25. The motor of claim 22 wherein the insert layer is formed integrally with the tubular housing to form a bore to which the first protective layer is applied.

26. A method of conducting electricity in a well drilling operation, the method comprising:

providing a downhole drilling motor, the motor including:

a tubular housing having a first longitudinal end and a second longitudinal end and a longitudinal bore having a sidewall, a stator disposed in the longitudinal bore of the tubular housing, said stator defining an internal cavity passing therethrough, wherein the stator includes a first protective electrically insulated layer, a second protective electrically insulated layer, and an electrically conductive layer disposed between the first and second electrically protective insulated layers, the first protective electrically insulated layer being disposed as a first substantially circumferential layer adjacent to an inner surface of the sidewall of the longitudinal bore of the tubular housing, the electrically conductive layer being disposed as a second substantially circumferential layer upon at least a portion of an inner surface of the first protective layer, and the second protective electrically insulated layer being disposed as a third substantially circumferential layer upon at least a portion of an inner surface of the electrically conductive layer, said electrically conductive layer coupled at a first end to a first electrical end conductor disposed proximal to the first longitudinal end of the tubular housing and coupled at a second end to a second electrical end conductor disposed proximal to the second longitudinal end of the tubular housing, and a rotor operatively positioned in the internal cavity to cooperate with the stator; providing electrical current to the conductive layer from the first electrical end conductor located proximal to the first longitudinal end;

conducting the electrical current along the conductive layer from the first longitudinal end of the housing to the second longitudinal end of the housing; and receiving the electrical current from the conductive layer at the second electrical end conductor located proximal to the second longitudinal end of the housing.

27. The method of claim 26 further comprising electrically coupling to the first electrical end conductor a first electrical device comprising an electrical power generator and electrically coupling to the second electrical end conductor a second electrical device comprising a power consumer.

28. The method of claim 26 further comprising electrically coupling to the first electrical end conductor a first electrical device comprising a data generator and coupling to the second electrical end conductor a second electrical device comprising a data receiver.

29. The method of claim 26 wherein providing the electrical current at the first electrical end conductor comprises providing a signal from a first device and receiving electrical current at the second electrical end conductor comprises receiving a signal from a first device, and said method further comprises transmitting the signal from the second electrical end conductor to a second device.

30. The method of claim 26 wherein providing the electrical current at the first electrical end conductor comprises providing electrical power and receiving electrical current at the second end comprises receiving electrical power, and said method further comprises conducting the electrical power from the second electrical end conductor to a device using the electrical power.

31. The method of claim 26 further including reversing the flow of electrical current and providing electrical current at the second electrical conductor, conducting the electrical current along the conductive layer, and receiving electric current at the first electrical end conductor.

32. A method of forming a stator of a drilling motor for well drilling operations, the method comprising:

providing a tubular housing having a first longitudinal end and a second longitudinal end and a longitudinal bore having a sidewall;

depositing a first protective electrically insulated layer as a first substantially circumferential layer deposited upon at least a portion of an inner surface of the sidewall of the longitudinal bore of the tubular housing;

depositing a first electrically conductive layer as a second substantially circumferential layer upon on at least a portion of an inner surface of the first substantially circumferential layer;

depositing a second protective electrically insulated layer as a third substantially circumferential layer upon at least a portion of an inner surface of the second substantially circumferential layer, an inner surface of the second protective layer defining an internal cavity passing therethrough;

coupling said first electrically conductive layer electrically at a first end to a first electrical end conductor disposed proximal to a first longitudinal end of the tubular housing; and coupling said first electrically conductive layer electrically at a second end to a second electrical end conductor disposed proximal to a second longitudinal end of the tubular housing.

33. The method of claim 32, wherein depositing a first electrically conductive layer comprises a fluid or particulate compound that is sprayed, coated, or otherwise deposited upon at least a portion of the inner surface of the first substantially circumferential layer.

34. A method of forming a stator of a drilling motor for well drilling operations, the method comprising:

providing a tubular housing having a first longitudinal end and a second longitudinal end and a longitudinal bore having a sidewall;

depositing a first protective electrically insulated layer as a first substantially circumferential layer deposited upon at least a portion of an inner surface of the sidewall of the longitudinal bore of the tubular housing;

depositing a first electrically conductive layer as a second substantially circumferential layer upon on at least a portion of an inner surface of the first substantially circumferential layer;

depositing a second protective electrically insulated layer as a third substantially circumferential layer upon at least a portion of an inner surface of the second substantially circumferential layer;

depositing a second electrically conductive layer as a fourth substantially circumferential layer upon on at least a portion of an inner surface of the third substantially circumferential layer;

depositing a third protective electrically insulated layer as a fifth substantially circumferential layer upon at least a portion of an inner surface of the fourth substantially circumferential layer, an inner surface of the fifth protective layer defining an internal cavity passing therethrough;

coupling said first electrically conductive layer electrically at a first end to a first electrical end conductor disposed proximal to the first longitudinal end of the tubular housing;

coupling said first electrically conductive layer electrically at a second end to a second electrical end conductor disposed proximal to the second longitudinal end of the tubular housing;

coupling said second electrically conductive layer electrically at a first end to a third electrical end conductor disposed proximal to the first longitudinal end of the tubular housing; and coupling said second electrically conductive layer electrically at a second end to a fourth electrical end conductor disposed proximal to the second longitudinal end of the tubular housing.

* * * * *

UNITED STATES PATENT AND TRADEMARK OFFICE

CERTIFICATE OF CORRECTION

PATENT NO. : 9,080,391 B2
APPLICATION NO. : 14/241537
DATED : July 14, 2015
INVENTOR(S) : Victor Gawski and John Kenneth Snyder It is certified that error appears in the above-identified patent and that said Letters Patent is hereby corrected as shown below:

On the title page under Abstract, Line 4, please replace "there through" with -- therethrough --

In the claims

Column 11, Line 9, please delete "of any" and insert -- of --

Column 11, Line 28, please delete "of any" and insert -- of --

Column 12, Line 51, please delete "upon on" and insert -- upon --

Column 13, Line 15, please delete "upon on" and insert -- upon --

Column 13, Line 23, please delete "upon on" and insert -- upon --

Signed and Sealed this
Fifth Day of April, 2016

Michelle K. Lee

Michelle K. Lee
*Director of the United States Patent and Trademark Office*